US009708877B2

(12) United States Patent
Liotta et al.

(10) Patent No.: US 9,708,877 B2
(45) Date of Patent: Jul. 18, 2017

(54) BLOWOUT PREVENTER MONITORING SYSTEM AND METHOD OF USING SAME

(71) Applicant: National Oilwell Varco, L.P., Houston, TX (US)

(72) Inventors: Joseph James Liotta, Houston, TX (US); Eric Trevor Ensley, Cypress, TX (US); Christopher Dale Johnson, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 14/614,211

(22) Filed: Feb. 4, 2015

(65) Prior Publication Data

US 2015/0159459 A1 Jun. 11, 2015

Related U.S. Application Data

(63) Continuation of application No. 13/168,594, filed on Jun. 24, 2011, now Pat. No. 8,978,698.

(60) Provisional application No. 61/360,783, filed on Jul. 1, 2010.

(51) Int. Cl.
*E21B 33/06* (2006.01)
*E21B 34/16* (2006.01)

(52) U.S. Cl.
CPC ..... *E21B 33/062* (2013.01); *E21B 33/06* (2013.01); *E21B 34/16* (2013.01); *Y10T 137/0318* (2015.04); *Y10T 137/8175* (2015.04); *Y10T 137/8225* (2015.04); *Y10T 137/8242* (2015.04); *Y10T 137/8292* (2015.04)

(58) Field of Classification Search
CPC ..... E21B 34/16; E21B 33/064
USPC ..... 251/1.1; 137/553, 554, 556
See application file for complete search history.

(56) References Cited

U.S. PATENT DOCUMENTS 899,029 A 9/1908 Connet
1,943,039 A * 1/1934 Randolph ..... C02F 1/686 137/100
4,084,671 A 4/1978 Ternehall
(Continued)

FOREIGN PATENT DOCUMENTS

CN 1299452 6/2001
CN 1587893 3/2005

OTHER PUBLICATIONS

Office Action and Translation for Chinese Patent Application No. 201180029361.3 dated Jun. 2, 2015, 19 pages.
(Continued)

*Primary Examiner* — Jessica Cahill
*Assistant Examiner* — Daphne M Barry
(74) *Attorney, Agent, or Firm* — Conley Rose, P.C.

(57) ABSTRACT

A blowout preventer for sealing a tubular of a wellbore is provided. The blowout preventer has a housing having a bore therethrough for receiving the tubular, at least one ram slidably positionable in the housing (each of the rams having a ram block for sealing engagement about the tubular), an actuator for selectively driving the ram block (the actuator comprising a piston slidably positionable in a cylinder), and a monitor for detecting the piston therein. The monitor has a visual indicator on an exterior of the cylinder. The visual indicator is operatively coupled to the piston for displaying a position of the piston as the piston travels within the cylinder whereby a position of the ram may be determined.

32 Claims, 13 Drawing Sheets

(56) References Cited

U.S. PATENT DOCUMENTS

| | | | | |
|---|---|---|---|---|
| 4,540,046 | A | 9/1985 | Granger et al. | |
| 4,543,649 | A | 9/1985 | Head et al. | |
| 4,647,002 | A | 3/1987 | Crutchfield | |
| 4,836,974 | A * | 6/1989 | Ezekoye | F16K 37/0008 116/277 |
| 4,877,217 | A | 10/1989 | Peil et al. | |
| 4,922,423 | A | 5/1990 | Koomey et al. | |
| 5,025,708 | A | 6/1991 | Smith et al. | |
| 5,074,518 | A | 12/1991 | Berry | |
| 5,150,049 | A | 9/1992 | Schuetz | |
| 5,287,879 | A | 2/1994 | Leggett et al. | |
| 5,320,325 | A | 6/1994 | Young et al. | |
| 5,407,172 | A * | 4/1995 | Young | E21B 33/062 137/554 |
| 5,575,452 | A | 11/1996 | Whitby et al. | |
| 5,655,745 | A | 8/1997 | Morrill | |
| 5,735,502 | A | 4/1998 | Levett et al. | |
| 5,897,094 | A | 4/1999 | Brugman et al. | |
| 6,173,770 | B1 | 1/2001 | Morrill | |
| 6,244,560 | B1 | 6/2001 | Johnson | |
| 6,374,925 | B1 | 4/2002 | Elkins et al. | |
| 6,427,576 | B1 | 8/2002 | Bock et al. | |
| 6,509,733 | B2 | 1/2003 | Blubaugh et al. | |
| 6,554,247 | B2 | 4/2003 | Berckenhoff et al. | |
| 6,877,565 | B2 | 4/2005 | Edvardsen | |
| 7,023,199 | B2 | 4/2006 | Blubaugh et al. | |
| 7,051,989 | B2 | 5/2006 | Springett et al. | |
| 7,121,185 | B2 | 10/2006 | Alrefai | |
| 7,234,530 | B2 | 6/2007 | Gass | |
| 7,274,989 | B2 | 9/2007 | Hopper | |
| 7,318,480 | B2 | 1/2008 | Hosie et al. | |
| 7,331,562 | B2 | 2/2008 | Springett et al. | |
| 7,437,988 | B2 | 10/2008 | Andersson et al. | |
| 7,762,338 | B2 | 7/2010 | Fenton et al. | |
| 7,980,305 | B2 | 7/2011 | Judge et al. | |
| 8,978,698 | B2 | 3/2015 | Liotta et al. | |
| 2004/0056653 | A1 | 3/2004 | Bocek et al. | |
| 2006/0213365 | A1 | 9/2006 | Dorr | |
| 2007/0102655 | A1 | 5/2007 | Springett | |
| 2008/0040070 | A1 | 2/2008 | McClanahan | |
| 2008/0196888 | A1 | 8/2008 | Judge et al. | |
| 2008/0197306 | A1 | 8/2008 | Judge | |
| 2008/0265188 | A1 | 10/2008 | Springett et al. | |
| 2009/0056132 | A1 | 3/2009 | Foote | |
| 2010/0152901 | A1 | 6/2010 | Judge et al. | |
| 2012/0001101 | A1 | 1/2012 | Dietz et al. | |

OTHER PUBLICATIONS

English Translation and Office Action for Chinese Patent Application No. 201180029361.3 dated Nov. 19, 2015, 7 pages.
English Translation and Office Action for Chinese Patent Application No. 201180029361.3 dated Sep. 24, 2014, 22 pages.
International Preliminary Report on Patentability for PCT Patent application No. PCT/US2011/041894 dated Jan. 8, 2013, 5 pages.
International Search Report and Written Opinion for PCT Patent Application No. PCT/US2011/41894 dated Jan. 5, 2012, 4 pages.
Extended European Search Report dated Mar. 17, 2016 for European Application No. 11801341.6, 9 pages.

* cited by examiner

BLOWOUT PREVENTER MONITORING SYSTEM AND METHOD OF USING SAME

CROSS-REFERENCE TO RELATED APPLICATIONS

This application is a continuation of U.S. application Ser. No. 13/168,594 filed Jun. 24, 2011, which claims the benefit of U.S. Provisional Application No. 61/360,783, filed on Jul. 1, 2010, the entire contents of which are hereby incorporated by reference.

BACKGROUND OF THE INVENTION

1. Field of the Invention

This present invention relates generally to techniques for performing wellsite operations. More specifically, the present invention relates to techniques for monitoring the operation of blowout preventers (BOPs), for example, involving determining a ram block location.

2. Description of Related Art

Oilfield operations are typically performed to locate and gather valuable downhole fluids. Oil rigs are positioned at wellsites and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Tubing or pipes are typically positioned in the wellbore to enable the passage of subsurface fluids to the surface.

Leakage of subsurface fluids may pose a significant environmental threat if released from the wellbore. Equipment, such as blow out preventers (BOPs), are often positioned about the wellbore to form a seal about pipes therein to prevent leakage of fluid as it is brought to the surface. In some cases, the BOPs employ rams and/or ram blocks that seal the wellbore. Some examples of ram BOPs and/or ram blocks are provided in U.S. Pat. Nos. 4,647,002, 6,173,770, 5,025,708, 7,051,989, 5,575,452, 6,374,925, 2008/0265188, 5,735,502, 5,897,094, 7,234,530 and 2009/0056132. The location of the ram and/or ram block of a BOP may be measured by visually looking at a tail shaft of the ram blocks. Ram position sensors may be provided as described, for example, in U.S. Pat. Nos. 2008/0197306, 4,922,423, 5,320,325, 5,407,172, and 7,274,989.

Despite the development of techniques involving BOPs and/or ram blocks, there remains a need to provide advanced techniques for monitoring BOP operation. The present invention is directed to fulfilling these needs in the art.

SUMMARY OF THE INVENTION

In at least one aspect, the invention relates to a blowout preventer for sealing a tubular of a wellbore. The wellbore penetrates a subterranean formation. The blowout preventer has a housing having a bore therethrough for receiving the tubular, at least one ram slidably positionable in the housing (each of the rams having a ram block for sealing engagement about the tubular), an actuator for selectively driving the ram block (the actuator having a piston slidably positionable in a cylinder), and a monitor for detecting the piston therein. The monitor includes a visual indicator on an exterior of the cylinder. The visual indicator is operatively coupled to the piston for displaying a position of the piston as the piston travels within the cylinder whereby a position of the ram may be determined.

The visual indicator may have a cable operatively connected to the piston. The cable may be operatively connectable to a dial via a pulley and rotatable thereby as the piston moves within the cylinder. The visual indicator may also have at least one gear for operatively coupling the pulley to the dial. The visual indicator may have a magnetic coupler for coupling the dial to the pulley. The visual indicator may have a housing integral with the cylinder.

The visual indicator may also have a plurality of flags positioned on a flag rod. The plurality of flags may be selectively raisable as the piston passes adjacent thereto. The visual indicator may have a magnet slidably positionable on a guide in response to a magnet on the piston passing adjacent thereto. The visual indicator may have a transparent case with a plurality of metal filings movably positionable therein in response to a magnet on the piston passing adjacent thereto. The visual indicator may have a transparent case with a magnetic indicator movably positionable therein in response to a magnet on the piston passing adjacent thereto. The blowout preventer may also have a visual indicator sensor for detecting the visual indicator.

The blowout preventer may also have an electrical indicator for detecting a position of the piston. The electrical indicator may have a magnet slidably positionable on a guide in response to a magnet on the piston passing adjacent thereto, and at least one Hall Effect sensor for detecting a position of the magnet on the guide. The electrical indicator may be an inductive resistance sensor comprising a coil disposed about the cylinder. The electrical indicator may have a top end ultrasonic sensor at a top end of the cylinder and a bottom end ultrasonic sensor at a bottom end of the cylinder for detecting the piston when adjacent thereto. The electrical indicator may have an ultrasonic limit sensor. The electrical indicator may be a laser sensor. The electrical indicator may have a capacitive displacement sensor. The electrical indicator may be a sonar sensor for emitting sonar waves and sensing the waves rebounded by the piston. The electrical indicator may have at least one proximity sensor. The electrical indicator may have a flow sensor for detecting the flow of fluid through a chamber of the cylinder as the piston passes therein.

In yet another aspect, the invention relates to a system for sealing a tubular of a wellbore. The system has a blowout preventer and an inspector for inspecting visual indicator.

The blowout preventer has a housing having a bore therethrough for receiving the tubular, at least one ram slidably positionable in the housing (each of the rams having a ram block for sealing engagement about the tubular), an actuator for selectively driving the ram block (the actuator having a piston slidably positionable in a cylinder), and a monitor for detecting the piston therein. The monitor includes a visual indicator on an exterior of the cylinder. The visual indicator is operatively coupled to the piston for displaying a position of the piston as the piston travels within the cylinder whereby a position of the ram may be determined.

The blowout preventer has a housing having a bore therethrough for receiving the tubular, at least one ram slidably positionable in the housing (each of the rams having a ram block for sealing engagement about the tubular), an actuator for selectively driving the ram block (the actuator having a piston slidably positionable in a cylinder), and a monitor for detecting the piston therein. The monitor includes a visual indicator on an exterior of the cylinder. The visual indicator is operatively coupled to the piston for displaying a position of the piston as the piston travels within the cylinder whereby a position of the ram may be determined.

The inspector may be a human or a remote operated vehicle (ROV). The system may also have a surface unit for receiving data from the monitor, an electrical indicator for detecting a position of the piston, a receiver for communicating signals with the electrical indicator, and/or at least one sensor for detecting wellsite parameters.

In yet another aspect, the invention relates to a method of monitoring a blowout preventer. The method involves positioning the blowout preventer about a tubular, activating at least one of the visual indicators of the monitor as the piston passes adjacent thereto, and inspecting the visual indicators. The blowout preventer has a housing having a bore therethrough for receiving the tubular, at least one ram slidably positionable in the housing (each of the rams having a ram block for sealing engagement about the tubular), an actuator for selectively driving the ram block (the actuator having a piston slidably positionable in a cylinder), and a monitor for detecting the piston therein. The monitor includes a visual indicator on an exterior of the cylinder. The visual indicator is operatively coupled to the piston for displaying a position of the piston as the piston travels within the cylinder whereby a position of the ram may be determined. The method may also involve sensing a position of the piston with an electrical indicator, manually viewing the visual indicators, sensing the visual indicator for activation, and/or passing data from the monitor to a surface unit.

Finally, in yet another aspect, the invention relates to a blowout preventer for sealing a tubular of a wellbore. The blowout preventer includes a housing having a bore therethrough for receiving the tubular, at least one ram slidably positionable in the housing (each of the at least one rams having a ram block for sealing engagement about the tubular), an actuator for selectively driving the ram block (the actuator comprising a piston slidably positionable in a cylinder), and a monitor for detecting the piston. The monitor has a housing with a cable therein. The cable is operatively connectable to the piston and movable therewith for activating a visual indicator on an exterior of the housing whereby a position of the ram may be displayed.

The monitor also may also have a sensor operatively connected for detecting movement of the cable and/or a communication link for passing data from the sensor to a surface unit. The visual indicator may have a dial rotationally movable by the cable. The monitor may also have a magnetic coupler inside of the housing for coupling the cable to the dial. The monitor also has at least one gear for operatively coupling the cable to the dial. The monitor may also have at least one pulley. The housing may be integral with the cylinder.

BRIEF DESCRIPTION DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are, therefore, not to be considered limiting of its scope, for the invention may admit to other equally effective embodiments. The Figures are not necessarily to scale and certain features, and certain views of the Figures may be shown exaggerated in scale or in schematic in the interest of clarity and conciseness.

DETAILED DESCRIPTION OF THE INVENTION

The description that follows includes exemplary apparatus, methods, techniques, and instruction sequences that embody techniques of the present inventive subject matter. However, it is understood that the described embodiments may be practiced without these specific details.

The invention is directed at techniques for providing more effective monitoring and/or measuring of the operation of the blowout preventer (BOP). The BOP may be provided with a monitor to detect, for example, a position (or location) of a ram of the BOP. These techniques may be used to provide monitoring, such as visual or electrical monitoring, of the BOP from the surface, such as while the BOP is in use on the seabed. Such monitoring techniques involve one or more of the following, among others: determination of BOP function, determination of ram position, determination of sealed position, constant monitoring of the ram position within the BOP, adaptability to wellsite equipment (e.g., various pipes diameters).

Figure 1:
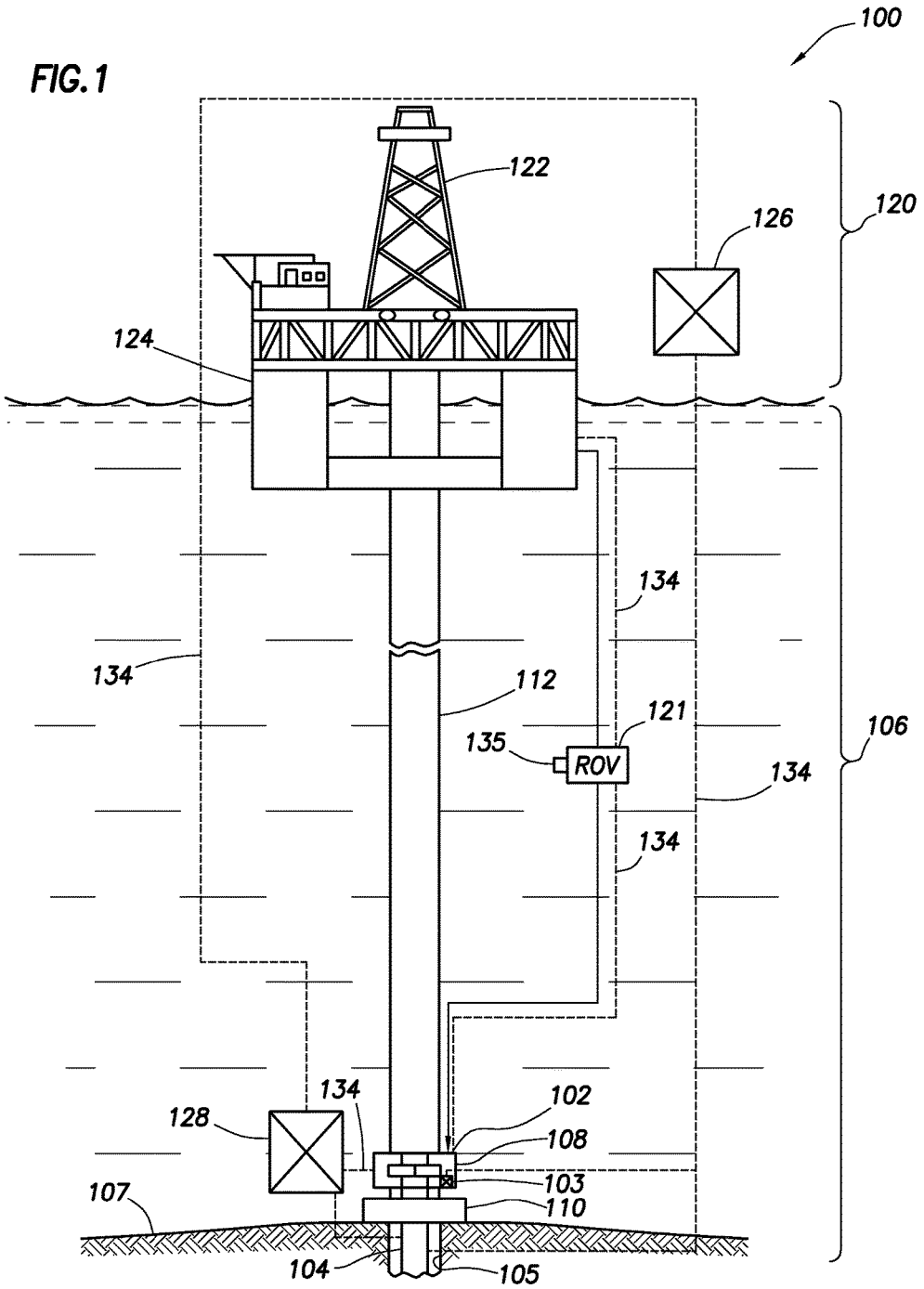
FIG. 1 shows a schematic view of an offshore wellsite having a blowout preventer (BOP) for sealing a tubular.

FIG. 1 depicts an offshore wellsite 100 having a seal assembly 102 configured to seal a wellbore 105 extending into in a seabed 107. As shown, the seal assembly 102 is positioned in a blowout preventer (BOP) 108 that is part of a subsea system 106 positioned on the seabed 107. The subsea system 106 may also comprise a pipe (or tubular) 104 extending from the wellbore 105, a wellhead 110 about the wellbore 105, a conduit 112 extending from the wellbore 105 and other subsea devices, such as a stripper and a conveyance delivery system (not shown). The BOP 108 may have a BOP monitoring system 103 for monitoring the operation of the BOP 108. While the wellsite 100 is depicted as a subsea operation, it will be appreciated that the wellsite 100 may be land or water based, and the seal assembly 102 may be used in any wellsite environment.

A surface system 120 may be used to facilitate operations at the offshore wellsite 100. The surface system 120 may include a rig 122, a platform 124 (or vessel) and a surface controller 126. Further, there may be one or more subsea controllers 128. While the surface controller 126 is shown as part of the surface system 120 at a surface location and the subsea controller 128 is shown as part of the subsea system 106 in a subsea location, it will be appreciated that one or more controllers may be located at various locations to control the surface and/or subsea systems.

To operate one or more seal assemblies 102 and monitor the BOP monitoring system 103 and/or other devices associated with the wellsite 100, the surface controller 126 and/or the subsea controller 128 may be placed in communication therewith. The surface controller 126, the subsea controller 128, and/or any devices at the wellsite 100 may communicate via one or more communication links 134. The communication links 134 may be any suitable communication means, such as hydraulic lines, pneumatic lines, wiring, fiber optics, telemetry, acoustics, wireless communication, any combination thereof, and the like. The seal assembly 102, the BOP monitoring system 103, the BOP 108, and/or other devices at the wellsite 100 may be automatically, manually and/or selectively operated via the surface and subsea controllers 126 and/or 128, respectively.

A remote operated vehicle (ROV) 121 may optionally be provided to travel below the surface and inspect the BOP monitoring system 103. The ROV 121 may be provided with a camera 135 to display images of the BOP monitoring system 103 and/or electrical communicators (e.g., communication link 134) for coupling to the BOP monitoring system 103. The ROV 121 may be in communication with the surface unit 126 via a communication link 134. In some cases, a diver or other inspector may be used to visually inspect the BOP monitoring system 103.

Figure 2:
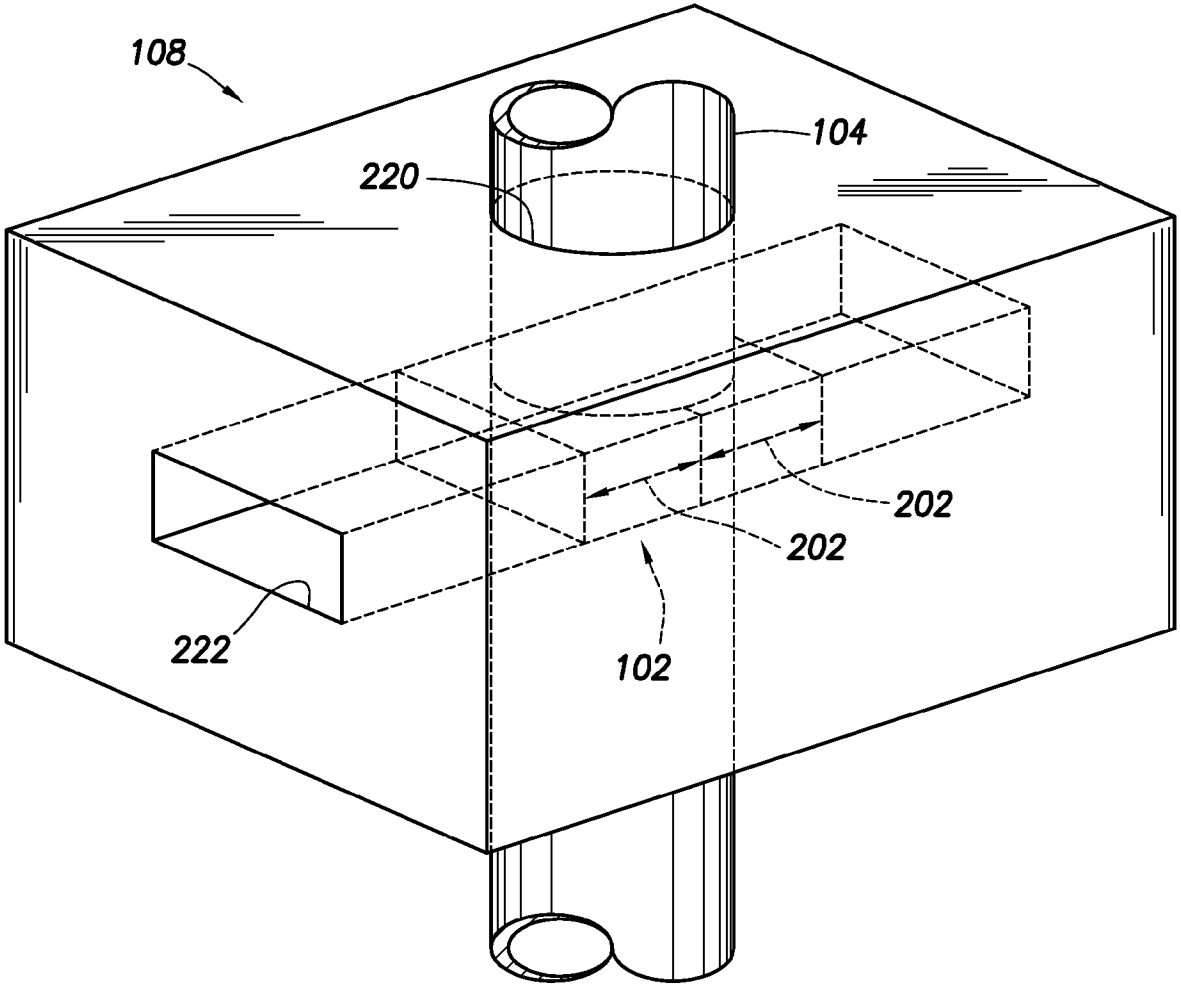
FIG. 2 shows a schematic perspective view of the BOP of FIG. 1.

FIG. 2 shows a schematic view of a BOP 108 that may be used as the BOP 108 of FIG. 1. The BOP 108 is schematically depicted as a cuboid-shaped device having a bore (or channel) 220 therethrough for receiving the pipe 104. The BOP 108 is also provided with a channel 222 therethrough for receiving the seal assembly 102. While the BOP 108 is depicted as having a specific configuration, it will be appreciated that the BOP 108 may have a variety of shapes, and be provided with other devices, such as sensors (not shown). An example of a BOP that may be used is described in U.S. Pat. No. 5,735,502, the entire contents of which is hereby incorporated by reference.

The seal assembly 102 comprises one or more rams 202 for sealing the BOP 108. The rams 202 may be any suitable device for sealing the interior of the BOP 108 and/or severing the pipe 104, for example rams, ram blocks, and/or shearing blades. Upon actuation of the rams 202 of the seal assembly 102, the rams 202 may move along the channel 222 toward the pipe 104. The seal assembly 102 may seal the pipe 104 within the BOP 108, thereby preventing fluids, such as wellbore fluids and/or sea water, from passing through the BOP 108. Further, the seal assembly 102 may severe the pipe 104 if the seal assembly 102 has shearing blades.

Figure 3:
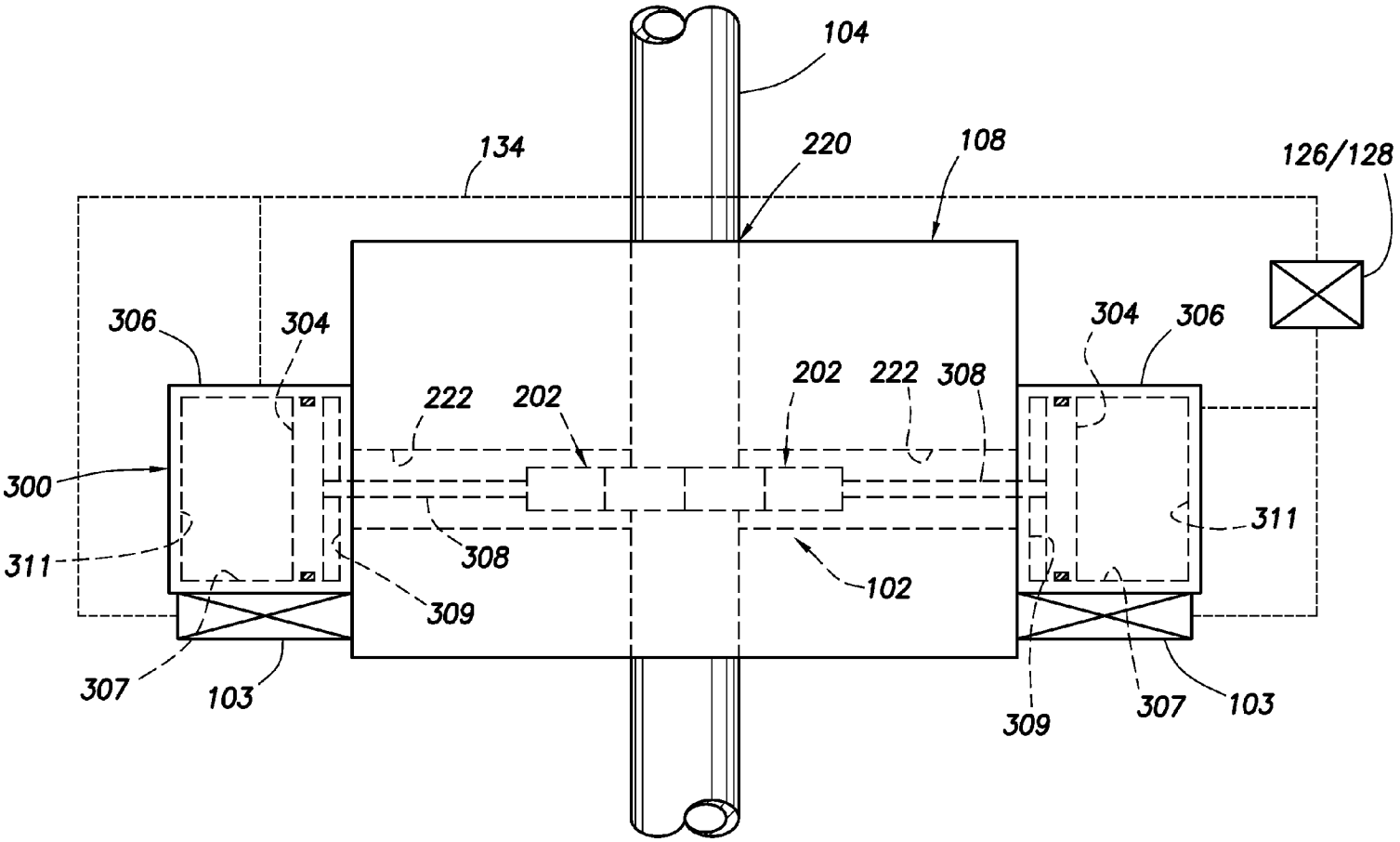
FIG. 3 shows a schematic side view of the BOP of FIG. 2 having one or more actuator(s) and a BOP monitoring system.

FIG. 3 shows a schematic side view of the BOP 108 of FIG. 2 having an actuator 300 coupled to each of the rams 202. The actuator 300 may be configured to move the rams 202 between an un-actuated position wherein the rams 202 are not engaged with the pipe 104 and an actuated position (as shown in FIG. 3) wherein the rams 202 are engaged with the pipe 104. In the un-actuated position, the pipe 104 may move through the BOP 108 and into and/or out of the wellbore 105 (see, e.g., FIG. 1). In the actuated position the pipe 104 and/or the central bore 220 of the BOP 108 may be sealed about pipe 104 by the rams 202.

The actuator 300 as shown, is a hydraulic actuator configured to move a piston 304 within a cylinder 306 using hydraulic fluid supplied to the actuator 300. The cylinder 306 has a side 307, a head 309 and a rear 311. The piston 304 is slidably movable within the cylinder 306 by, for example, hydraulic pressure selectively applied thereto. The piston 304 may couple to a rod 308 (or ram shaft) that is configured to move the rams 202 as piston 304 moves. Although the actuator 300 is shown as a hydraulic piston and cylinder, the actuator 300 may be any suitable actuator for moving the rams 202 between the actuated and the un-actuated positions.

As the piston 304 moves within the cylinder 306, the BOP monitoring system 103 may monitor the location of the piston 304. With the location of the piston 304 determined, the location of the rams 202 within the BOP 108 may be determined. The data collected by the BOP monitoring system 103 may be sent via the communication links 134 to the surface and subsea controller(s) 126/128 in order to, for example, determine how the BOP 108 is operating. The BOP monitoring system 103 may be any suitable system for determining the location of the pistons 304, the rods 308 and/or the rams 202 within the BOP 108. Preferably, the monitoring system 103 is also capable of determining other downhole parameters of the BOP 108, its components and/or associated downhole conditions.

Figure 4A:
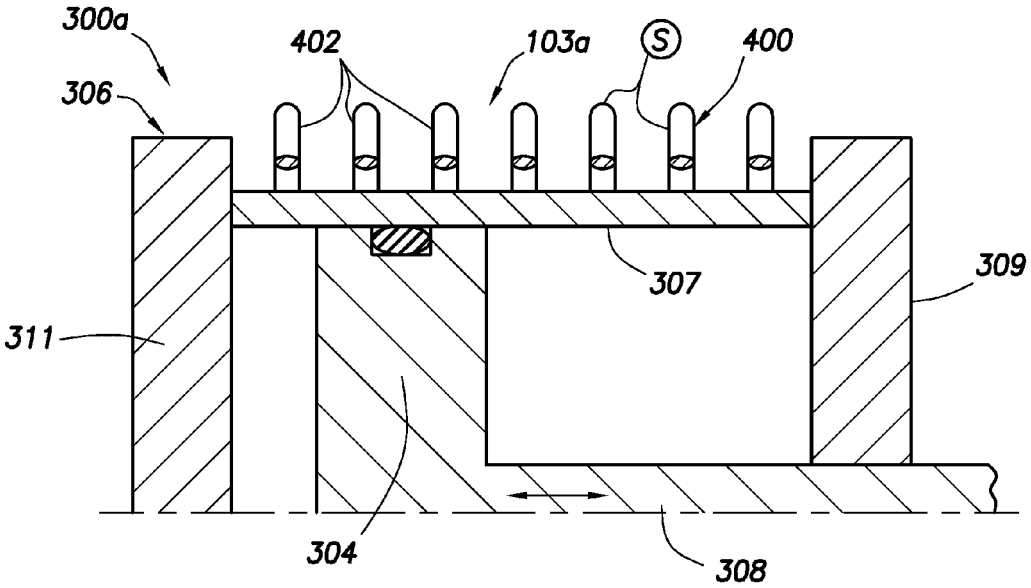
FIGS. 4A-4N show schematic cross-sectional views of various versions of a portion of an actuator and a monitoring system operatively connected thereto.
Figure 4B:
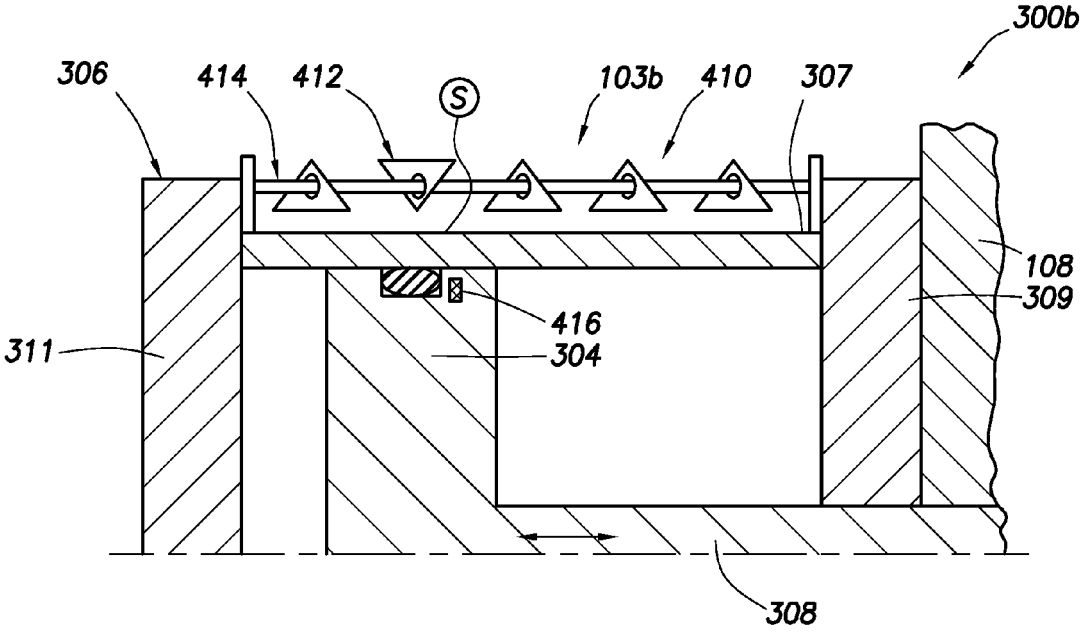
Figure 4C:
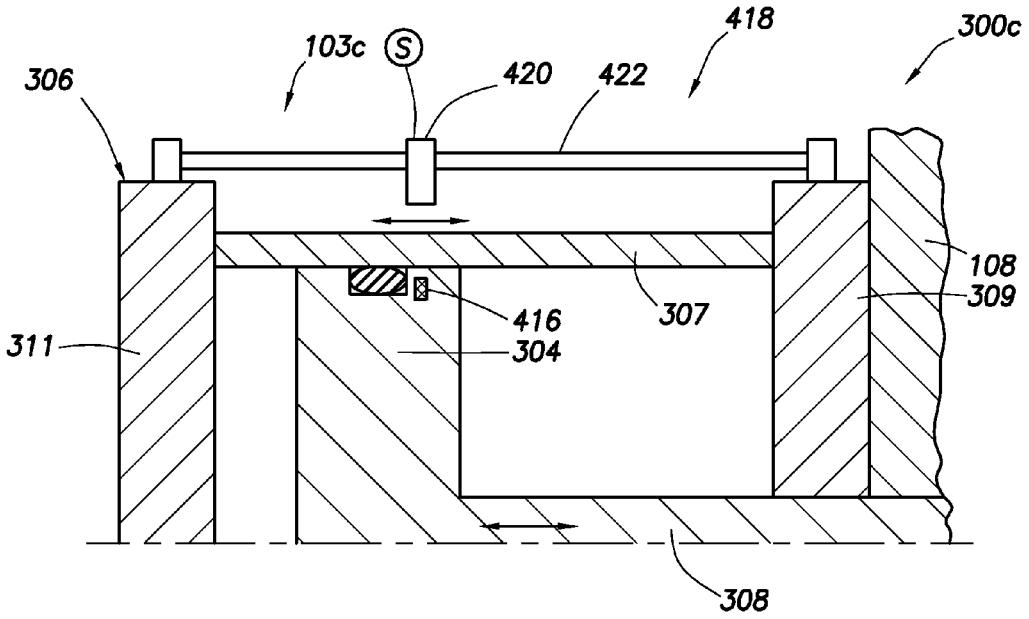
Figure 4D:
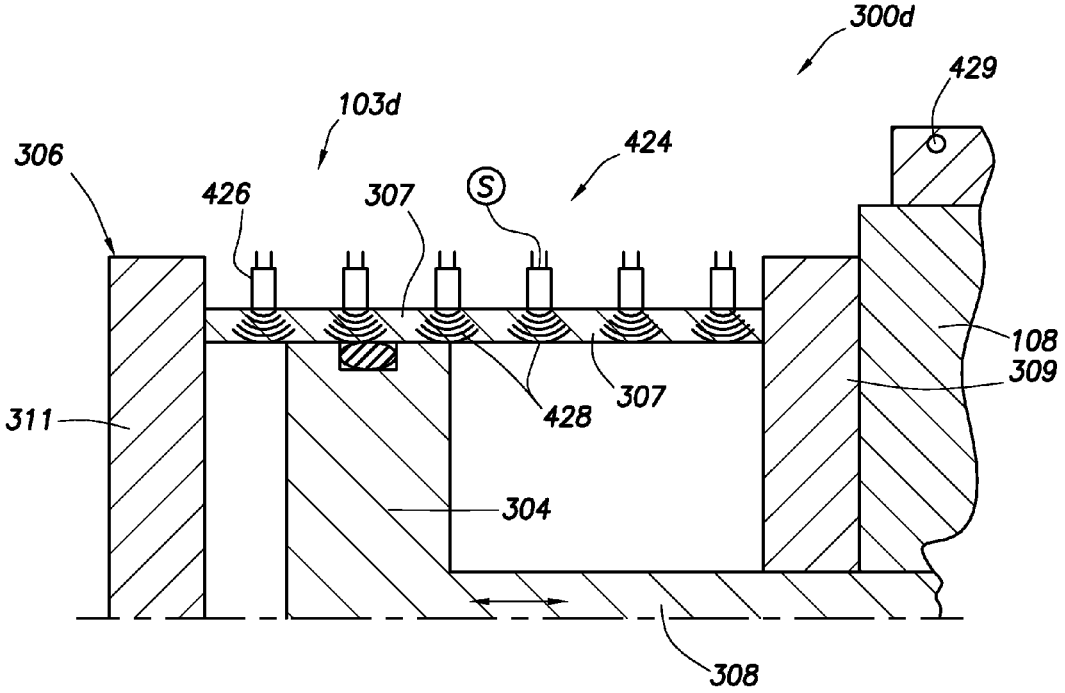
Figure 4E:
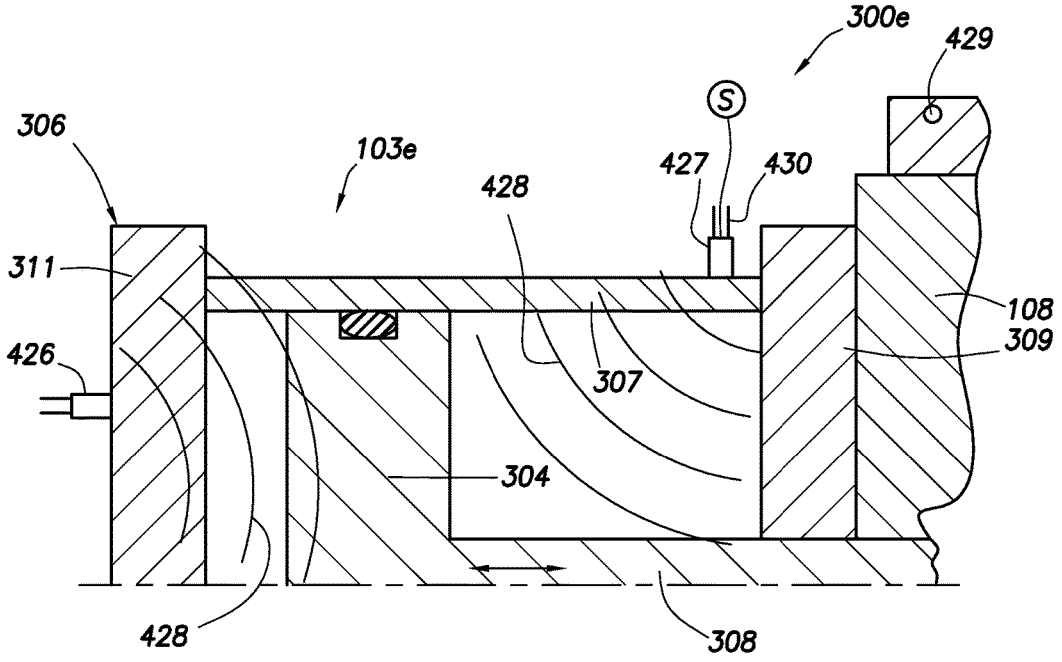
Figure 4F:
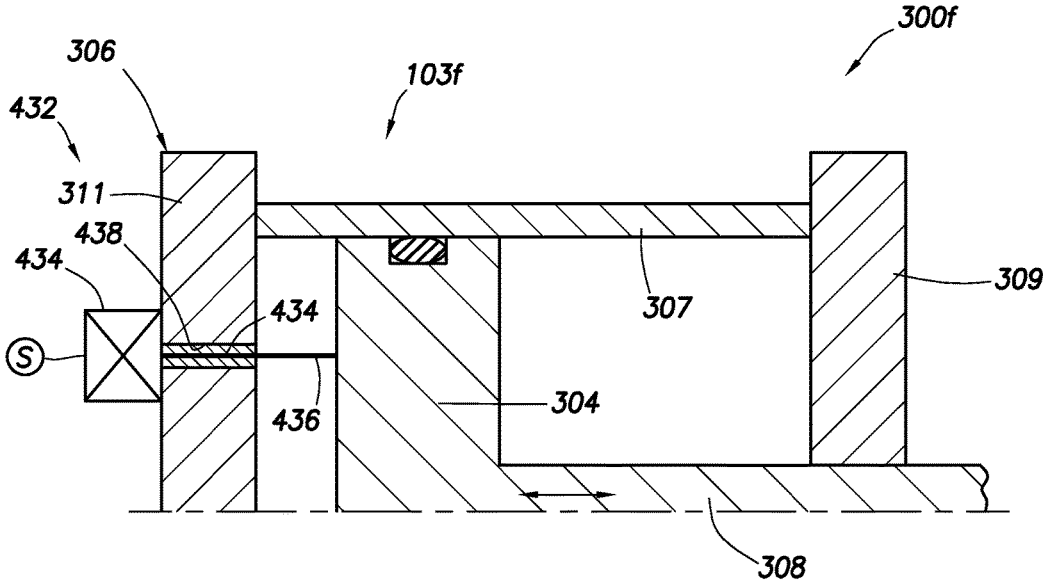
Figure 4G:
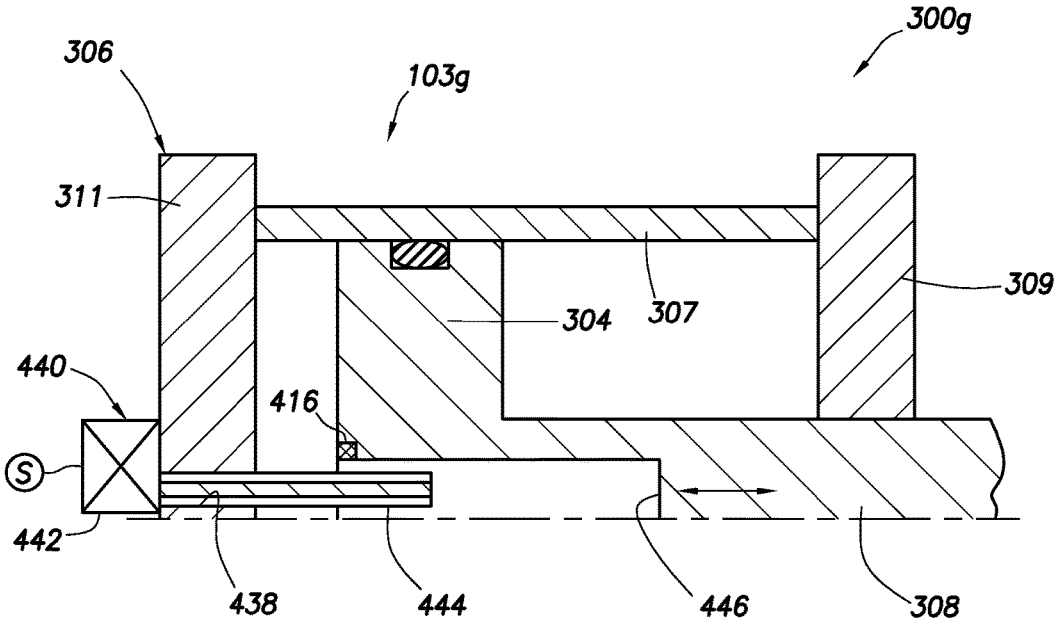
Figure 4H:
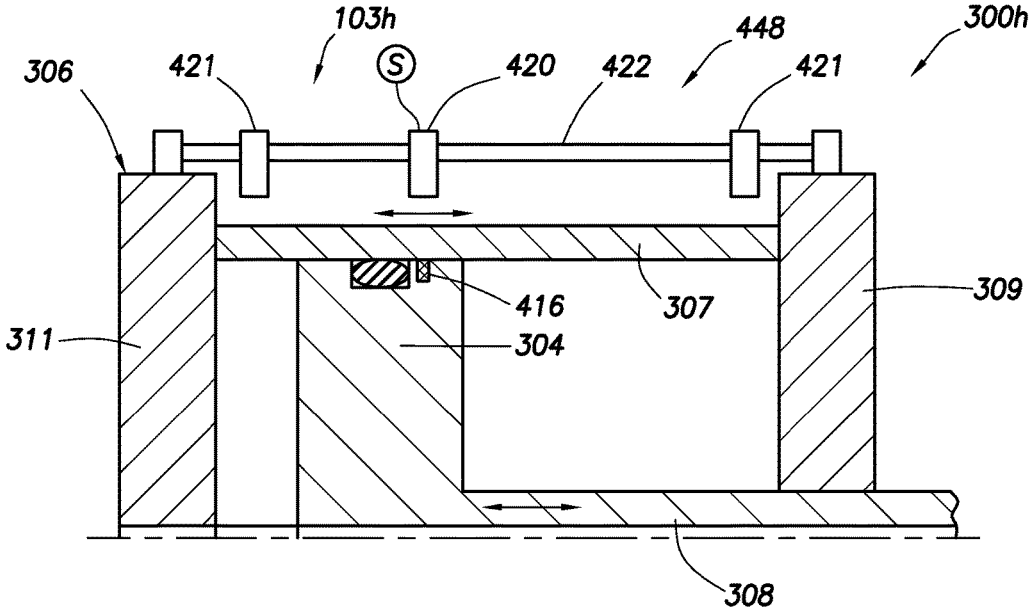
Figure 4I:
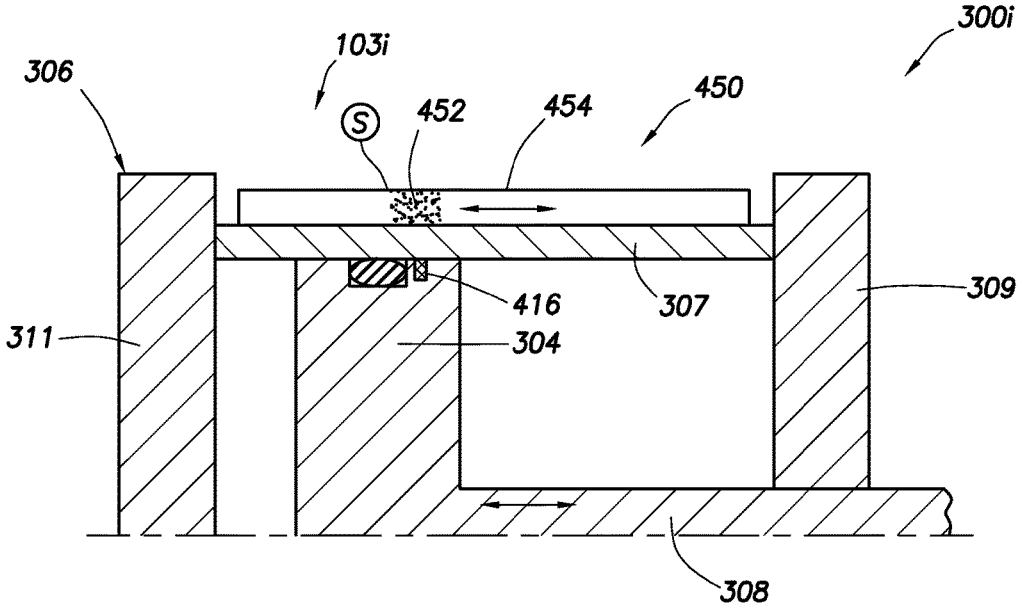
Figure 4J:
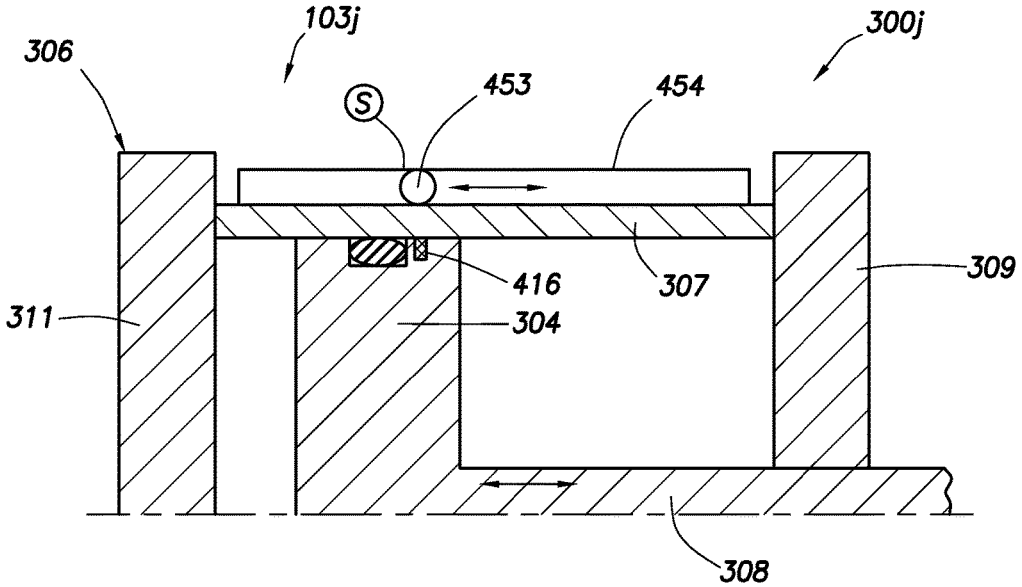
Figure 4K:
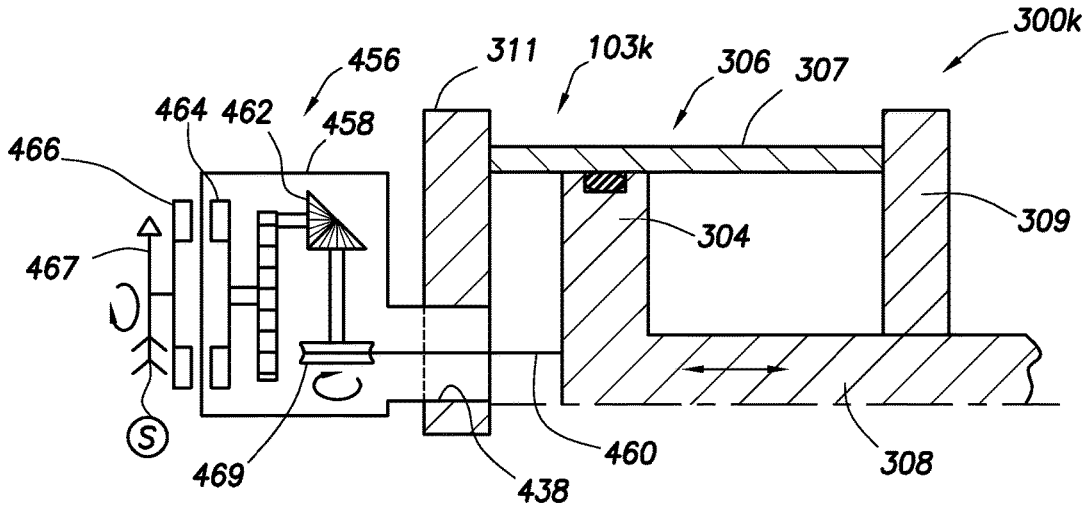
Figure 4L:
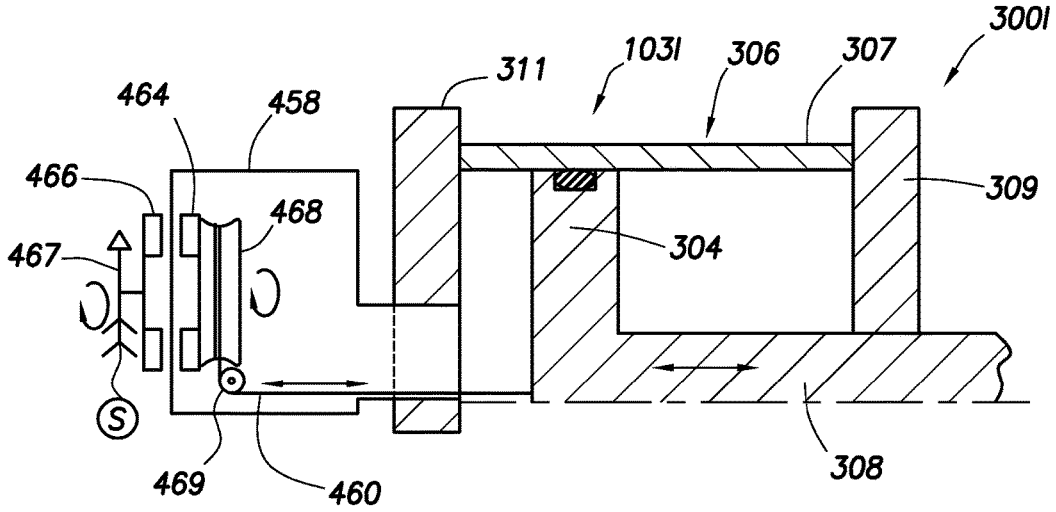
Figure 4M:
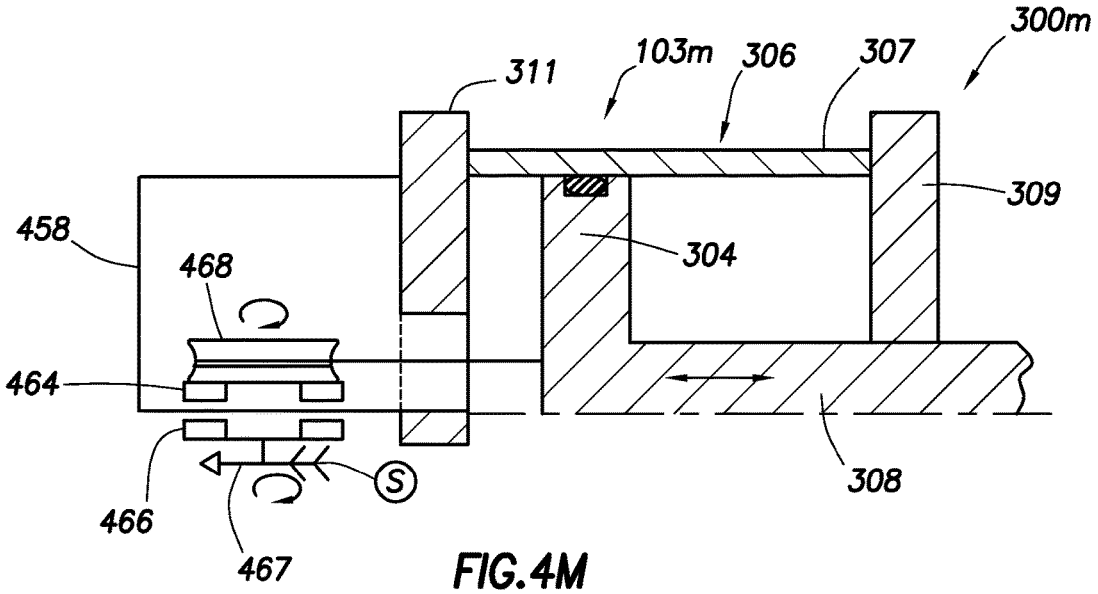
Figure 4N:
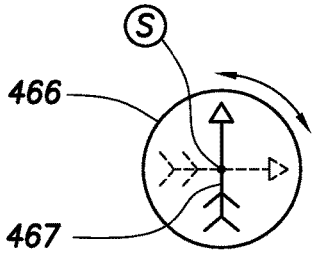

FIGS. 4A-4N depict cross-sectional views of a portion of the actuator 300*a-m* having various versions of a monitoring system 103*a-m* usable as the actuator 300 and BOP monitoring system 103 of FIG. 3. As shown in each of these figures, the piston 304 is slidably movable within the cylinder 306. The monitoring systems 103*a-m* are each positionable about the cylinder 306 and have devices for detecting a position of the piston 304 therein. Each piston 304 is operatively connectable to a ram 202 (see FIGS. 2 and 3) and, therefore, a position of the rams 202 (and/or components thereof) may also be determined. A visual indicator sensor S may optionally be positioned about the monitoring systems for detecting activation, position, or other parameters of the wellsite and/or components, such as the monitoring system 103*a-m*.

FIG. 4A depicts an actuator 300*a* with a BOP monitoring system 103*a* as an inductive resistance sensor 400. The inductive resistance sensor 400 may have one or more coils 402 that wrap around the outside of the side 307 of the cylinder 306. A current may be supplied to the coils 402 and a resistance in the coils 402 may be measured during the operation of the actuator(s) 300*a*.

The piston 304 travels within the cylinder 306 between the cylinder head 309 and the cylinder rear 311 of the BOP 108. The resistance in the coils 402 changes as a function of the location of the piston 304. The coils 402 may individually change as the piston 304 passes thereby, thus indicating that the piston 304 is adjacent to a certain coil 402. The changes in resistance may be used to determine the location of the piston 304 and the rod 308. Thus, the location of the rams 202 (as shown in FIG. 3) may also be determined. The inductance of the coils may be measured and received by the ROV 121 and/or the surface unit 126 (FIG. 1) to provide an electrical indication of the location of the piston 304 and the ram 202. Sensor S may be provided to pass signals from the coils 402 to a receiver positioned about the wellsite 100. A visual indicator, such as those provided herein, may also optionally be coupled to the monitoring system 103*a* to provide a visual indication of position upon activation by the monitoring system 103*a*.

FIG. 4B depicts an actuator 300*b* with a BOP monitoring system 103*b* as a magnetic flag sensor 410. The magnetic flag sensor 410 may have one or more magnetic flags 412 located on the outside of a side 307 of the cylinder 306. Each of the magnetic flags 412 may be secured to the cylinder 306 on an axis 414 that allows the magnetic flag 412 to rotate thereabout in response to a piston magnet 416 passing thereby. Each magnetic flag 412 may be magnetic, or have a magnet thereon. Each magnetic flag 412 may be at a downward position gravitationally, and raise as the piston magnet 416 passes thereby.

The piston magnet 416 may be any magnet secured to, or proximate the piston 304. As the piston 304 travels within the cylinder 306 between the cylinder rear 311 and the cylinder head 309, the piston magnet 416 raises the magnet flags 412 proximate the piston 304. The raised magnet flags 412 may be used to provide a visual indication of the location of the piston 304 and the rod 308. Thus, the location of the rams 202 (as shown in FIG. 3) may also be indicated. The sensor S may also be operatively coupled to one or more flags to provide an electrical and/or visual indication of the activation of a given flag. The sensor S may pass the signal to various components for communicating a position of the piston 304.

FIG. 4C depicts an actuator 300*c* with a BOP monitoring system 103*c* as a sliding magnetic sensor 418. The sliding magnetic sensor 418 may have one or more sliding magnets 420 secured to a guide rod 422 located on the outside of the side 307 of the cylinder 306. Each of the sliding magnets 420 may be secured to the guide rod 422 in a manner that allows the sliding magnet 420 to translate along the guide rod 422 in response to the movement of the piston magnet 416.

As the piston 304 travels within the cylinder 306 between the cylinder rear 311 and the cylinder head 309, the piston 304 with a magnet 416 thereon translates the sliding magnet 420 proximate the piston 304. The location of the sliding magnet 420 may provide a visual indicator of the piston 304. Limit switches or other devices, such as sensor S, may also be used to detect and/or communicate the position of the sliding magnet 420 along the guide rod 422. The sliding magnet 420 location may be used to determine the location of the piston 304 and the rod 308. Thus, the location of the rams 202 (as shown in FIG. 3) may also be determined.

FIG. 4D depicts an actuator 300*d* and a BOP monitoring system 103*d* as an ultrasonic sensor 424. The ultrasonic sensor 424 may have one or more ultrasonic inducers 426 located around the outside of side 307 of the cylinder 306. Each of the ultrasonic inducers 426 produce ultrasonic waves 428 that are directed into an interior of the cylinder 306 and then detected by a receiver 429. As shown, the receiver 429 is positioned in the BOP 108.

Changes in the ultrasonic waves 428 may indicate the location of the piston 304 proximate to one or more of the ultra sonic inducers 426. As the piston 304 travels within the cylinder 306 between the cylinder rear 311 and the cylinder head 309, the detected changes in the ultrasonic waves 428 may be used to determine the location of the piston 304 and the rod 308. Thus, the location of the rams 202 (as shown in FIG. 3) may also be determined. The ultrasonic waves detected by the receiver 429 may be passed to the ROV 121 and/or the surface unit 126 (FIG. 1) to provide an indication of the location of the piston 304 and the ram 202. The sensor S may also be operatively coupled to one or more ultrasonic inducers 426 to provide an electrical and/or visual indication of the activation of a given ultrasonic inducer. The sensor S may pass the signal to various components, such as receiver 429, for communicating a position of the piston 304.

A visual indicator, such as those provided herein, may also optionally be coupled to the monitoring system 103*d* to provide a visual indication of position upon activation by the monitoring system 103*d*.

FIG. 4E depicts an actuator 300*e* and a BOP monitoring system 103*e* as an ultrasonic limit sensor 430. The ultrasonic limit sensor 430 may have two ultra sonic inducers 426, 427 each located proximate a travel limit of the piston 304 within cylinder 306. For example, one of the ultrasonic inducers 426 may be located proximate the cylinder rear 311 and the second ultrasonic inducer 427 may be located adjacent the side 307 of the cylinder 306. The second ultrasonic inducer 427 on the side 307 may be located proximate the travel limit adjacent cylinder head 309 of the piston 304.

Each of the ultrasonic inducers 426, 427 produce the ultrasonic waves 428 that are directed into an interior of the cylinder 306 and then detected by a receiver 429. Changes in the ultrasonic waves 428 may indicate the location of the piston 304 proximate to the ultra sonic inducer 426, 427. As the piston 304 travels within the cylinder 306 between the cylinder rear 311 and the cylinder head 309, the detected changes in the ultrasonic waves 428 indicate when the piston 304 reaches the travel limits in either the un-actuated position or the actuated position. Therefore, the detected changes in the ultrasonic waves 428 may be used to determine a position of the piston 304 and the rod 308. Thus, the location of the rams 202 (as shown in FIG. 3) may also be determined. The ultrasonic waves detected by the receiver 429 may be passed to the ROV 121 and/or the surface unit 126 (FIG. 1) to provide an indication of the location of the piston 304 and the ram 202. The sensor S may also be operatively coupled to one or more ultrasonic inducers 426, 427 to provide an electrical and/or visual indication of the activation of a given ultrasonic inducer.

The sensor S may pass the signal to various components, such as receiver 429, for communicating a position of the piston 304. A visual indicator, such as those provided herein, may also optionally be coupled to the monitoring system 103*e* to provide a visual indication of position upon activation by the monitoring system 103*e*.

FIG. 4F depicts an actuator 300*f* and a BOP monitoring system 103*f* as a laser sensor 432. The laser sensor 432 may have one or more laser inducers 434 located proximate the end of the actuator 300*f*. As shown, the laser inducers 434 are located proximate the cylinder rear 311. The laser inducer 434 may direct a laser 436 through an aperture 438 of the cylinder 306.

The laser 436 may engage a portion of the piston 304. The laser 436 may have conventional range finding capabilities that may be used to determine the distance between the cylinder rear 311 and the piston 304 as the piston travels within the cylinder 306. The piston 304 location as determined by the laser sensor 432 may be used to determine the location of the piston 304 and the rod 308. Thus, the location of the rams 202 (as shown in FIG. 3) may also be determined. The location detected by the laser sensor 432 may be passed to the ROV 121 and/or the surface unit 126 (FIG. 1) to provide an indication of the location of the piston 304 and the ram 202. The sensor S may also be operatively coupled to the monitoring system 103*f* to provide an electrical and/or visual indication of the position detected by the laser 436. The sensor S may pass the signal to various components for communicating a position of the piston 304. A visual indicator, such as those provided herein, may also optionally be coupled to the monitoring system 103*f* to provide a visual indication of position upon activation by the monitoring system 103*f*.

FIG. 4G depicts an actuator 300*g* and a BOP monitoring system 103*g* as a linear magnetic sensor 440. The linear magnetic sensor 440 may have a sensor magnet 442 coupled to the cylinder rear 311. The sensor magnet 442 may couple to a linear sensor 444 that is placed into the cylinder 306 through an aperture 438 in the cylinder rear 311. The linear sensor 444 may detect movement of a piston magnet 416 as the piston 304 moves. As shown, the piston 304 may have a cavity 446 for allowing the piston 304 to pass the linear sensor 444 without engaging the linear sensor 444.

As the piston 304 travels within the cylinder 306 between the cylinder rear 311 and the cylinder head 309, the linear sensor 444 detects the location of the piston magnet 416. The piston magnet 416 location may be used to determine the location of the piston 304 and the rod 308. Thus, the location of the rams 202 (as shown in FIG. 3) may also be determined. The location detected by the linear sensor 444 may be passed to the ROV 121 and/or the surface unit 126 (FIG. 1) to provide an indication of the location of the piston 304 and the ram 202. The sensor S may also be operatively coupled to the monitoring system 103*g* to provide an electrical and/or visual indication of the position detected by the linear sensor 444. The sensor S may pass the signal to various components for communicating a position of the piston 304. A visual indicator, such as those provided herein, may also optionally be coupled to the monitoring system 103*g* to provide a visual indication of position upon activation by the monitoring system 103*g*.

FIG. 4H depicts an actuator 300*h* and a BOP monitoring system 103*h* as a Hall Effect sensor 448. The Hall Effect sensor 448 may have one or more sliding magnets 420 secured to the guide rod 422 located on the outside of the side 307 of the cylinder 306. Each of the sliding magnets 420 may be secured to the guide rod 422 in a manner that allows the sliding magnet 420 to translate along the guide rod 422 in response to the movement of a piston magnet 416 on piston 304. As the piston 304 travels within the cylinder 306 between the cylinder rear 311 and the cylinder hear 309, the piston magnet 416 translates the sliding magnet 420 proximate the piston 304.

Proximity sensors 421 may be positioned on either side of sliding magnet 420 to detect the position of the sliding magnet. The magnet 420 may be detected by the proximity sensors 421 as the magnet approaches thereby indicating the position of the piston 304. Therefore, the Hall Effect sensor 448 may provide a specific electrical and/or visual indication of the piston 304 and the rod 308 position or location. Thus, the location of the rams 202 (as shown in FIG. 3) may also be determined. The location detected by the Hall Effect sensor 448 may be passed to the ROV 121 and/or the surface unit 126 (FIG. 1) to provide an indication of the location of the piston 304 and the ram 202. The sensor S may also be operatively coupled to the monitoring system 103*h* to provide an electrical and/or visual indication of the position detected by the linear sensor 444. The sensor S may pass the signal to various components for communicating a position of the Hall Effect sensor 448.

FIG. 4I depicts an actuator 300*i* and a BOP monitoring system 103*i* as a moving magnetic sensor 450. The moving magnetic sensor 450 may have one or more magnetic indicators (or filings) 452 located within a transparent case 454. The transparent case 454 may be, for example, a tube located on the outside of the side 307 of the cylinder 306. Each of the magnetic indicators 452 may be secured within the transparent case 454 proximate the cylinder 306 in a manner that allows the magnetic indicator 452 to translate within the transparent case 454 in response to the movement of the piston magnet 416.

As shown in FIG. 4I, the magnetic indicator 452 is a plurality of magnetic shavings. However, the magnetic indicator 452 may be any suitable indicator such as one or more magnetic ball(s) (as shown in FIG. 4J).

The transparent case 454 may have any suitable form for allowing the magnetic indicator 452 to travel. The transparent case 454 may be transparent to allow for visual inspection of the location of the magnetic indicator 452, as the magnetic indicator 452 travels within the transparent case 454. The magnetic indicator 452 may be used to provide a visual indication of the location of the piston 304 and the rod 308. As the piston 304 travels within the cylinder 306 between the cylinder rear 311 and the cylinder head 309, a piston magnet 416 on piston 304 translates the magnetic indicator 452 through the transparent case 454 to a position proximate the piston 304. The magnetic indicator 452 location may be used to determine the location of the piston 304 and the rod 308. Thus, the location of the rams 202 (as shown in FIG. 3) may also be determined. The sensor S may also be operatively coupled to the monitoring system 103*i* to provide an electrical and/or visual indication of the position detected by the magnetic indicator 452. The sensor S may pass the signal to various components for communicating a position of the piston 304.

FIG. 4J depicts an actuator 300*j* with a BOP monitoring system 103*j* as another moving magnetic sensor 453. The monitoring system 103*j* is similar to the monitoring system 103*i*, except that the transparent case 454 as shown in FIG. 4J may be a transparent race (or tube) for receiving the magnetic indicator 453 and allowing it to translate therein. The magnetic sensor 453 may be, for example, a ball that rolls through the transparent race as the piston moves within the cylinder 306.

As the piston 304 travels within the cylinder 306 between the cylinder head 309 and the rear 311 of the BOP 108, the piston magnet 416 translates the magnetic indicator 453 proximate the piston 304. The magnetic indicator 453 location within the transparent tube may be used to provide a visual indication of the location of the piston 304 and the rod 308. Thus, the location of the rams 202 (as shown in FIG. 3) may also be determined. The magnetic indicator 453 location may be used to determine the location of the piston 304 and the rod 308. Thus, the location of the rams 202 (as shown in FIG. 3) may also be determined. The sensor S may also be operatively coupled to the monitoring system 103*j* to provide an electrical and/or visual indication of the position detected by the magnetic indicator 453. The sensor S may pass the signal to various components for communicating a position of the piston 304.

FIGS. 4K-4N depict various configurations of a pulley monitor 103*k,l,l'*. FIGS. 4K-4M depict longitudinal cross-sectional views of an actuator 300*k,l,l'*, and FIG. 4N depicts an end view thereof. FIG. 4K depicts an actuator 300*k* and a BOP monitoring system 103*k* as a gear drive sensor 456. The gear drive sensor 456 may have a gear drive housing 458 coupled to the cylinder rear 311. The gear drive housing 458 may have a cable (or flexible member) 460 that is placed into the cylinder 306 through an aperture 438 therein. The cable 460 may couple to the piston 304 and travel therewith as the piston 304 travels within the cylinder 306. A pulley 469 may be provided to drive the gears 462 as the cable 460 moves with the piston 304.

As the piston 304 moves from the un-actuated position to the actuated position, the cable 460 may be pulled by the piston 304. The cable 460 movement may rotate one or more gears 462 located within the gear drive housing 458. One of the gears 462 may couple to and/or rotate a first portion of a magnetic coupler 464 located within the gear drive housing 458.

The first portion of the magnetic coupler 464 may magnetically couple to a second portion of the magnetic coupler 466 located outside of the gear drive housing 458.

The rotation of the second portion of the magnetic coupler 466 may be measured and used to determine the location of the piston 304 as it travels within the cylinder 306. An indicator arrow 467 may be positioned on the magnetic coupler 466 and rotated therewith. The position of the indicator arrow 467 may be used as an electrical and/or visual indicator to indicate the position of the piston 304. As shown in FIG. 4N, the indicator arrow may rotate to a position along the second portion of the magnetic coupler 466. The rotational position of the indicator arrow 467 may correlate to a position of the piston in cylinder 306.

The gears 462 may be spring wound in order to retract the cable 460 when the piston 304 travels from the actuated position to the un-actuated position. The piston 304 location as visually indicated by the indicator arrow 467 may be used to determine the location of the piston 304 and rod 308. Thus, the location of the rams 202 (as shown in FIG. 3) may also be determined.

FIG. 4L depicts an actuator 300*l* with a BOP monitoring system 103*l* as a pulley drive. In the system 103*l* as shown in FIG. 4L, the cable 460 wraps around a first pulley 469 and a second pulley 468 within the pulley housing 458. Thus, as the piston 304 moves within the cylinder 306, the pulley 468 is rotated. The pulley 468 may couple to the first portion of the magnetic coupler 464 located within the pulley housing 458. The first portion of the magnetic coupler 464 may magnetically couple to the second portion of the magnetic coupler 466 located outside of the pulley housing 458.

The rotation of the second portion of the magnetic coupler 466 may be measured and used to determine the location of the piston 304 and the rod 308 as it travels within the cylinder 306 in a similar manner as that described for FIG. 4K. As also described with respect to FIG. 4J, the indicator arrow 467 may be used to provide an electrical and/or visual indication of the piston 304. Thus, the location of the rams 202 (as shown in FIG. 3) may also be determined.

FIG. 4M depicts an actuator 300*m* with a BOP monitoring system 103*m* as a pulley drive. The actuator 300*m* is similar to the actuator 300*l*, except that the pulley housing 458 and contents are rotated 90 degrees, and the pulley housing 458 is integral with the cylinder 306. As indicated by FIG. 4M, the visual indicators (or monitors) herein may be positioned at various locations about the cylinder 306 to facilitate viewing thereof. As also indicated by FIG. 4M, the visual indicators (or monitors) may be positioned in housings integral with the cylinder 306 (or separate from as shown by FIGS. 4K and 4L).

The rotation of the second portion of the magnetic coupler 466 may be measured and used to determine the location of the piston 304 and the rod 308 as it travels within the cylinder 306 in a similar manner as that described for FIG. 4K. As also described with respect to FIG. 4J, the indicator arrow 467 may be used to provide a visual indication of the piston 304. Thus, the location of the rams 202 (as shown in FIG. 3) may also be determined.

The movement of arrow 467 may be detected by a sensor S. The sensor S may also be operatively coupled to the monitoring system 103*k-m* to provide an electrical or visual indication of the position of the arrow 467. The sensor S may pass the signal to various components for communicating a position of the piston 304.

FIGS. 5A-5D depict alternate schematic, cross-sectional views of an actuator 300*m-p* having various versions of a monitoring system 103*m-p* usable as the actuator 300 and BOP monitoring system 103 of FIG. 3 and depicting the operation thereof.

As shown in each of these figures, the piston 304 is slidably movable within the cylinder 306. In these figures, for simplicity, the rod 308 is not shown. The monitoring systems 103*m-p* are each positionable about the cylinder 306 and have devices for detecting a position of the piston 304 therein. Each piston 304 is operatively connectable to a ram 202 (see FIGS. 2 and 3) and, therefore, a position of the rams 202 (and/or components thereof) may also be determined. In each of these monitoring systems 103*m-p*, a sensor S may also be operatively coupled to the monitoring system 103*m-p* to provide an electrical and/or visual indication of the detected position of the piston 304. The sensor S may pass the signal to various components for communicating a position of the piston 304. A visual indicator, such as those provided herein, may also optionally be coupled to the monitoring system 103*m-p* to provide a visual indication of position upon activation by the monitoring system 103*g*.

Figure 5A:
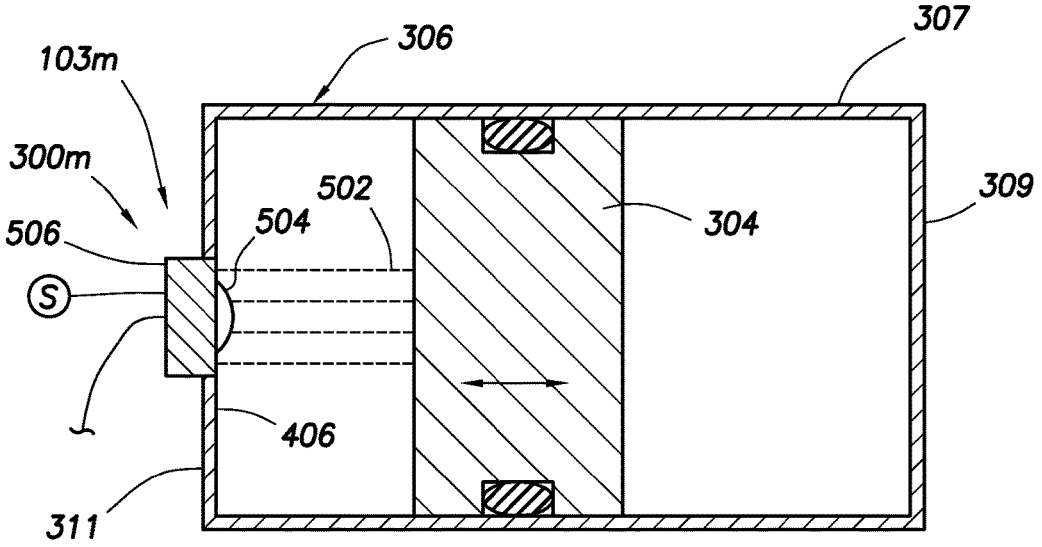
FIGS. 5A-5D show schematic cross-sectional views of additional versions of an actuator and a monitoring system operatively connected thereto.

FIG. 5A depicts an actuator 300*m* and a BOP monitoring system 103*m* as a capacitive displacement sensor 506. The capacitive displacement sensor 506 may flow a current 502 within the cylinder 306. The current 502 may be sent into the cylinder 306 with one or more source electrodes 504 coupled to the cylinder rear 311.

A sensor electrode 506 may detect the current after the current has engaged the piston 304. Changes in the current detected by the sensor electrode 506 may be used to determine the distance of the piston 304 from the cylinder rear 311. The piston 304 location may be used to determine the location of the piston 304 (and the rod 308 not shown). Thus, the location of the rams 202 (as shown in FIG. 3) may also be determined.

Figure 5B:
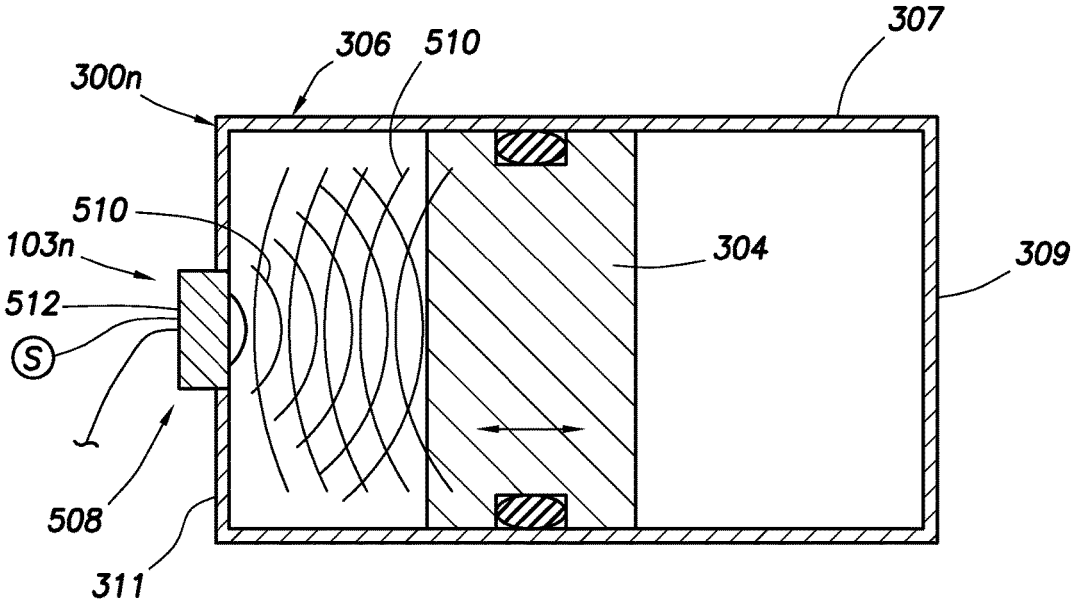

FIG. 5B depicts an actuator 300*n* and a BOP monitoring system 103*n* as a sonar sensor 508. The sonar sensor 508 may produce a sonic wave 510 within the cylinder 306.

The sonic wave 510 may be propagated into the cylinder 306 and reflected off of the piston 304. The reflected sonic wave 510 may be detected by a receiver 512.

Changes in the detected sonic wave 510 may be used to determine the distance of the piston 304 from the cylinder rear 311. The piston 304 location may be used to determine the location of the piston 304 (and rod 308 not shown). Thus, the location of the rams 202 (as shown in FIG. 3) may also be determined.

Figure 5C:
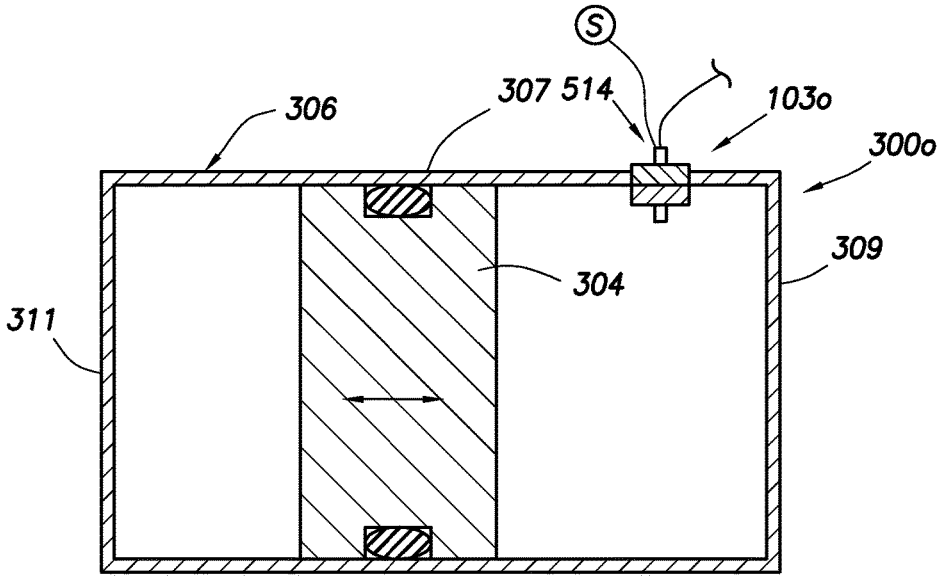

FIG. 5C depicts an actuator 300*o* and a BOP monitoring system 103*o* as one or more proximity sensor(s) 514. The proximity sensor(s) 514 may be any suitable detection sensor that determines the location of the piston 304 within the cylinder 306. For example, the proximity sensor 514 may be a mechanical sensor such as a button or a switch, an electrical sensor such as a strain gauge, a sonar sensor, and the like. The proximity sensor 514 may be coupled to, for example, the ROV 121 or surface unit 126.

The proximity sensor(s) 514 may detect the location of the piston 304 when the piston 304 is in the actuated and/or un-actuated position. There may also be multiple proximity sensor(s) 514 along the cylinder 306 in order to give the location of the piston 304 as the piston 304 translates within the cylinder 306. The piston 304 location may be used to determine the location of the piston 306 (and rod 308 not shown). Thus, the location of the rams 202 (as shown in FIG. 3) may also be determined.

Figure 5D:
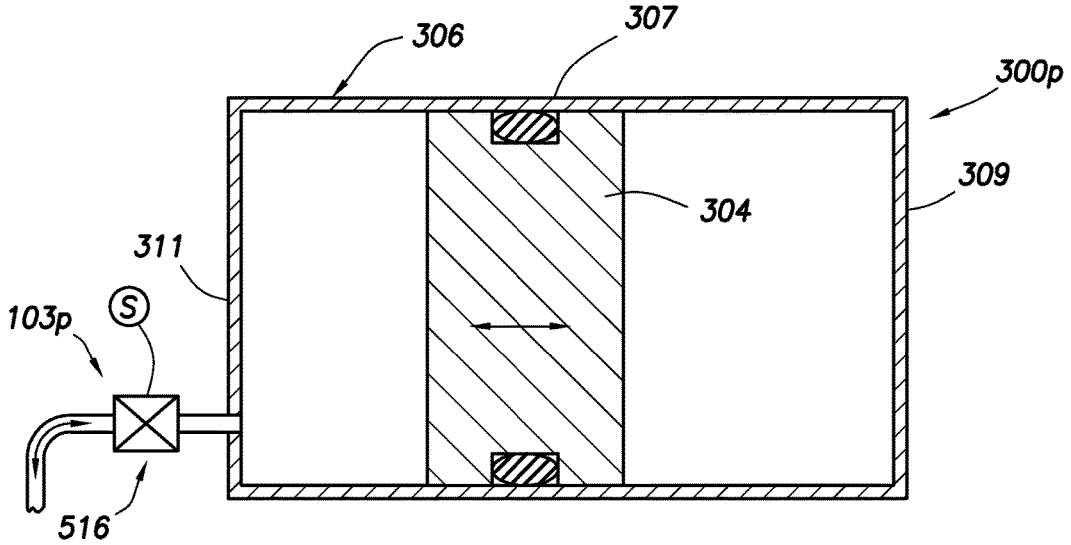

FIG. 5D depicts an actuator 300*p* and a BOP monitoring system 103*p* as a flow sensor 516. The flow sensor 516 may be, for example, a totalizing mechanical flow meter configured to measure the flow into and/or out of the cylinder 306 as the piston 304 is extended and retracted. The flow sensor 516 may be coupled to a fluid source, such as a tank (not shown).

Pumps, flowlines or other fluid devices may be provided to assist in manipulating the flow of fluid through the flow sensor 516.

With the inner volume of the cylinder known, the hydraulic flow into the cylinder may be used to calculate the position of the piston 304 within the cylinder. Alternatively, when the piston 304 is retracted toward the un-actuated position, the mechanical flow meter may reset back to zero instead of measuring the outflow. The piston 304 location may be used to determine the location of the piston 304 (and rod 308 not shown). Thus, the location of the rams 202 (as shown in FIG. 3) may also be determined.

Each of the monitors 103*a-p* depicted in FIGS. 4A-4N, 5A-5D may be used to indicate a position of the piston 304. These monitors 103*a-p* may be coupled via a communication link (e.g., 134 of FIG. 1) to the ROV 121 and/or surface unit 126 for passing signals therebetween. Such signals may contain data that may indicate (or be analyzed to indicate) the position of the piston 304. Some of the monitors 103*a-p* may provide visual indicators (e.g., monitors 103*b-c,i-l*), such as the flags 412 of FIG. 4B, magnets 420 of FIGS. 4C and 4H, magnetic indicators 452, 453 of FIGS. 4I and 4J, that may be visually inspected by an operator, ROV, camera or other devices to determine a position of the piston. The visual indicators may also be provided with visual indicator sensors to electrically indicate a position of the sensors. Some of the monitors 103*a-p* may provide monitor sensors having electrical indicators (e.g., monitors 103*a,d-h,m-p*) that may send signals to the surface unit indicating a position of the piston. One or more cylinders 306 of a BOP 108 may be provided with one or more of the monitors 103*a-p* about various locations.

Figure 6:
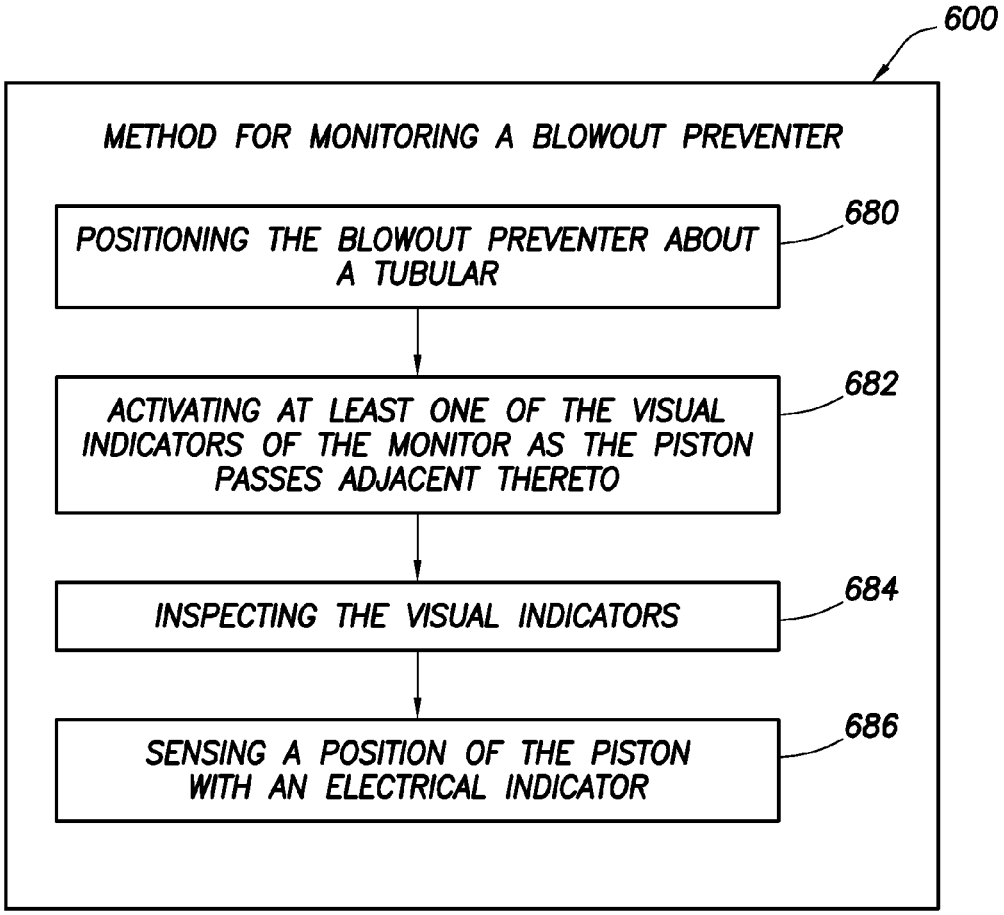
FIG. 6 depicts a method of monitoring a BOP.

FIG. 6 is a flow chart depicting a method (600) for monitoring a blowout preventer. The method (600) involves positioning (680) the blowout preventer about a tubular, activating (682) at least one of the visual indicators of the monitor as the piston passes adjacent thereto, inspecting (684) the visual indicators, and sensing (686) a position of the piston with an electrical indicator. The inspecting may also involve manually viewing the visual indicators and/or sensing the visual indicators for activation. The method may also involve additional steps, such as passing data from the monitor to a surface unit. The steps may be performed in an order, and repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more monitors may be positioned about one or more cylinders of a blowout preventer. Also, the monitoring devices described herein may detect positions of the piston 304 (and other portions of the ram 202) in an unactuated position, an actuated position, and/or all other positions therebetween.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A blowout preventer for sealing a tubular of a wellbore, the wellbore penetrating a subterranean formation, the blowout preventer comprising:

a blowout preventer housing having a bore therethrough to receive the tubular;

at least one ram slidably positionable in the housing, each of the at least one rams having a ram block positionable in sealing engagement about the tubular;

an actuator to selectively drive the ram block, the actuator comprising a piston slidably positionable in a cylinder; and a monitor comprising a pulley, a cable, and an indicator, wherein the cable is operatively connected to each of the pulley and the piston and movable therewith, wherein the indicator is directly connected to the pulley and movable thereby, and wherein a position of the ram may be determined by at least one of a rotational position of the pulley and a rotational position of the indicator.

2. The blowout preventer of claim 1, wherein the cable is extendable by rotation of the pulley.

3. The blowout preventer of claim 2, wherein the at least one pulley comprises a pulley wheel, the cable disposable about the pulley wheel to change direction of the cable.

4. The blowout preventer of claim 1, wherein the monitor further comprises gears.

5. The blowout preventer of claim 4, wherein the gears comprise a cable gear movable with the cable and a dial gear operatively connected to a dial, the dial rotated via the dial gear by the cable gear.

6. The blowout preventer of claim 1, wherein the monitor further comprises a monitor housing.

7. The blowout preventer of claim 6, wherein the monitor housing comprises a gear box housing with gears therein, the gears operatively connectable to the cable and the indicator to translate movement therebetween.

8. The blowout preventer of claim 6, wherein the indicator is positionable outside the monitor housing and the cable is operatively connectable to a pulley positionable in the housing.

9. The blowout preventer of claim 8, wherein the monitor further comprises a magnetic coupler, a first portion of the magnetic coupler operatively connectable to the cable and the indicator to translate movement therebetween through the monitor housing.

10. The blowout preventer of claim 1, wherein the monitor further comprises a magnetic coupler operatively connectable to the indicator and the cable to translate movement therebetween.

11. The blowout preventer of claim 10, wherein the magnetic coupler comprises an inside portion rotatably connectable inside the housing and an outside portion rotatably connectable outside the housing, the inside portion operatively connectable to the cable and movable therewith, the outside portion operatively connectable to the indicator and rotatable therewith.

12. The blowout preventer of claim 1, wherein the monitor further comprises a coupling operatively connecting the indicator to the cable to indicate movement of the cable.

13. The blowout preventer of claim 1, wherein the monitor further comprises a dial.

14. The blowout preventer of claim 1, wherein the monitor further comprises a sensor.

15. The blowout preventer of claim 14, wherein the sensor comprises one of a Hall Effect sensor, an inductive resistance sensor, ultrasonic sensor, a limit sensor, a capacitive displacement sensor, a sonar sensor, a proximity sensor, a flow sensor, a wellsite sensor, or a cable sensor.

16. The blowout preventer of claim 14, wherein the sensor comprises a cable sensor operatively connectable to the cable to detect a position thereof.

17. The blowout preventer of claim 1, wherein the indicator comprises a dial movable with the cable about a scale.

18. The blowout preventer of claim 17, wherein the indicator comprises the dial rotatable relative to movement of the cable and wherein the sensor comprises a visual indicator sensor operatively connectable to the dial to detect a rotational position thereof.

19. The blowout preventer of claim 1, wherein the indicator comprises one of a visual and an electric indicator.

20. The blowout preventer of claim 1, wherein the indicator comprises an arrow rotatable about a monitor housing of the monitor.

21. The blowout preventer of claim 1, further comprising a visual indicator comprising at least one of a magnet, a Hall effect sensor, an electrical indicator, a coil, an ultrasonic sensor, a laser sensor, flags, metal filings, a capacitive displacement sensor, a flow sensor, and combinations thereof.

22. A system for sealing a tubular of a wellbore, the well bore penetrating a subterranean formation, the system comprising:

a blowout preventer, comprising:

a blowout preventer housing having a bore therethrough to receive the tubular;

at least one ram slidably positionable in the housing, each of the at least one rams having a ram block positionable in sealing engagement about the tubular;

an actuator to selectively drive the ram block, the actuator comprising a piston slidably positionable in a cylinder; and a monitor, comprising:

a monitor housing;

an indicator positionable exterior to the monitor housing;

a cable operatively connectable to the piston and movable therewith, the cable extending through the housing and the cylinder; and a pulley positionable in the housing, the pulley operatively connectable to the cable and the indicator to translate movement therebetween whereby a position of the ram may be determined.

23. The system of claim 22, further comprising a surface unit operatively connectable to the monitor to receive data therefrom.

24. The system of claim 23, wherein the monitor further comprises a sensor to sense the data from the indicator, the sensor communicatively coupled to the surface unit.

25. The system of claim 22, further comprising an inspector to inspect a visual indicator.

26. The system of claim 25, wherein the inspector is one of an operator and a remote operated vehicle (ROV).

27. The system of claim 22, further comprising at least one wellsite sensor for detecting wellsite parameters.

28. The system of claim 22, wherein the monitor further comprises a magnetic coupler operatively connectable to the indicator and the cable to translate movement therebetween.

29. A method of sealing a tubular of a wellbore, the wellbore penetrating a subterranean formation, the method comprising:

providing a blowout preventer, comprising a blowout preventer housing, at least one ram slidably positionable in the housing, and an actuator, each of the at least one rams having a ram block positionable in sealing engagement about the tubular, the actuator comprising a piston slidably positionable in a cylinder to selectively drive the ram block; and providing a monitor comprising a pulley, a cable operatively connectable to each of the pulley and the piston, and an indicator directly connected to the pulley;

driving the ram block of each of the at least one rams with the actuator;

moving the indicator with the piston via the cable; and determining a position of the ram with the indicator by at least one of a rotational position of the pulley and a rotational position of the indicator.

30. The method of claim 29, wherein the determining comprises visually inspecting the indicator.

31. The method of claim 29, wherein the determining comprises electrically sensing the indicator.

32. The method of claim 29, further comprising passing data from the monitor to a surface unit.

* * * * *